US005448879A

United States Patent [19]

Concetti

[11] Patent Number: 5,448,879

[45] Date of Patent: Sep. 12, 1995

[54] AUTOMATIC MACHINE FOR FORMING, FILLING AND SEALING SACKS AND THE LIKE

[75] Inventor: Teodoro Concetti, Bastia Umbra, Italy

[73] Assignee: Concetti S.p.A., Bastia Umbra, Italy

[21] Appl. No.: 140,396

[22] Filed: Oct. 25, 1993

[30] Foreign Application Priority Data

Oct. 27, 1992 [IT] Italy ..... RM92A0779

[51] Int. Cl.[6] ..... B65B 9/10

[52] U.S. Cl. ..... 53/567; 53/570; 53/284.7; 53/459

[58] Field of Search ..... 53/550, 567, 568, 570, 53/571, 284.7, 459

[56] References Cited

U.S. PATENT DOCUMENTS

| | | | |
|---|---|---|---|
| 4,510,736 | 4/1985 | Müller | 53/284.7 |
| 5,086,609 | 2/1992 | Tetenborg | 53/570 |

FOREIGN PATENT DOCUMENTS

| | | | |
|---|---|---|---|
| 439789 | 7/1991 | European Pat. Off. . | |
| 2418228 | 10/1975 | Germany | 53/570 |
| 2950553 | 7/1981 | Germany . | |
| 4035298 | 5/1992 | Germany . | |
| 1576433 | 10/1980 | United Kingdom | 53/573 |

*Primary Examiner*—John Sipos
*Assistant Examiner*—Ed Tolan
*Attorney, Agent, or Firm*—Browdy and Neimark

[57] ABSTRACT

A machine is described comprising an arrangement of means for making-to-measure single sacks starting from a continuous tubular tape of heat-sealable plastic material, with simultaneous welding of the respective ends, for filling each of said sacks with the product in question, and for sealing the upper opening of each sack so filled, said arrangement being such as to allow translation of said sacks along a horizontal straight route, and said translation being arranged in such a way that in travelling said route a single time a first of said sacks, being empty, is taken to be filled and a second of said sacks, being full, is taken to have its mouth sealed.

8 Claims, 8 Drawing Sheets 1
16
21
2
3
42
25
58
54
34
36
26
52
60
55
23
24

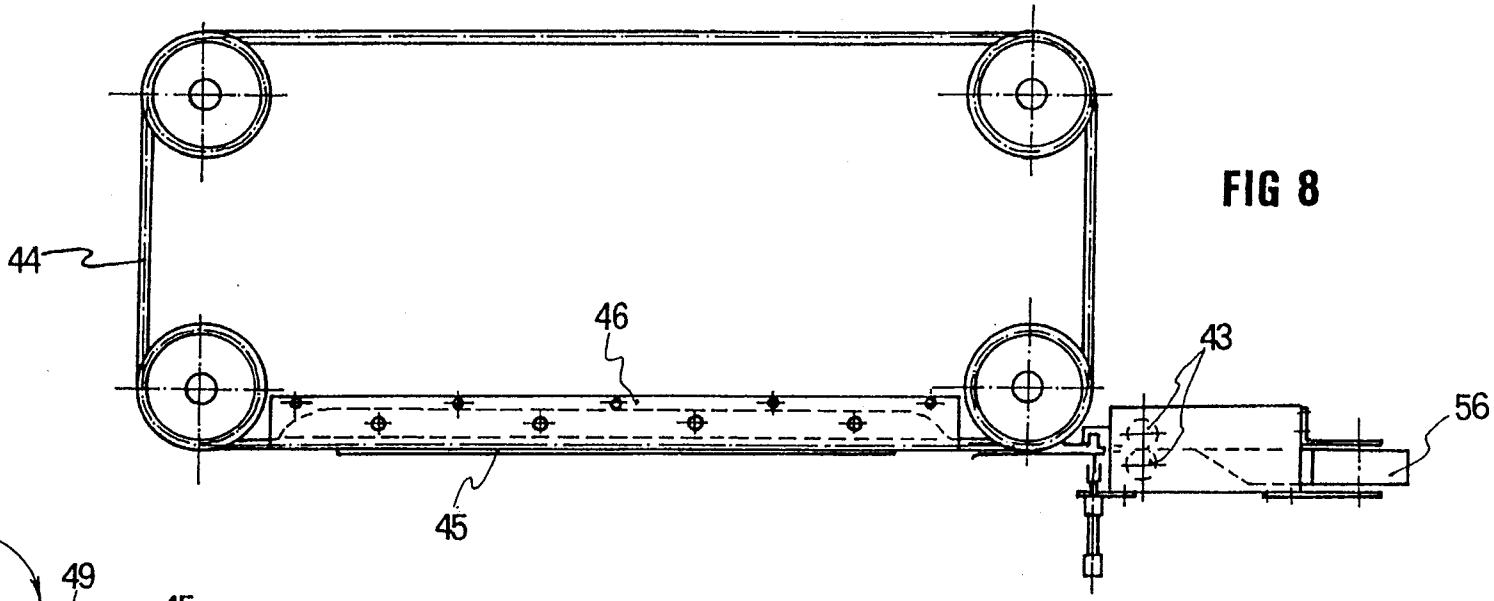
FIG 8
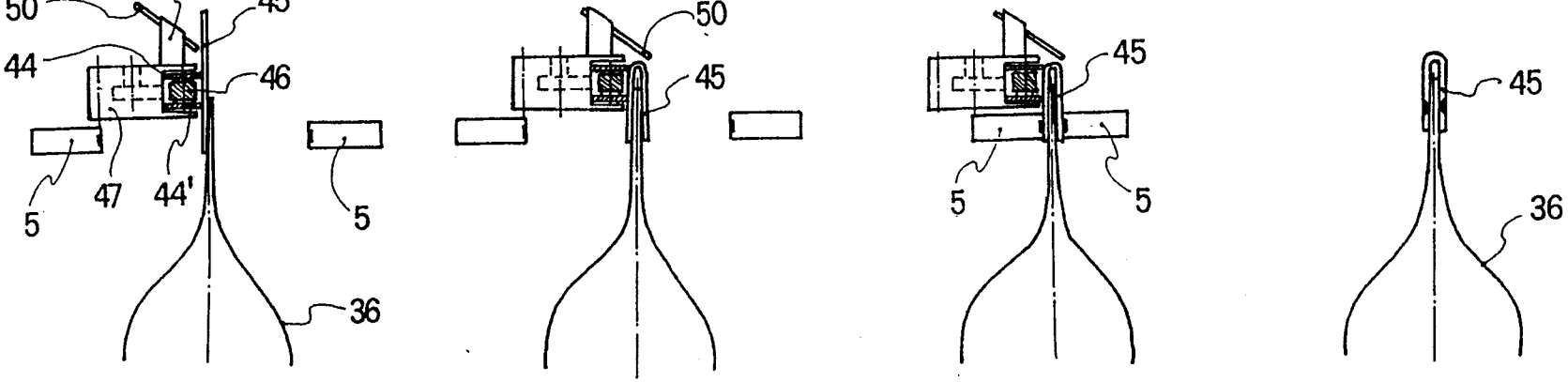
FIG 12
FIG 11
FIG 10
FIG 9

AUTOMATIC MACHINE FOR FORMING, FILLING AND SEALING SACKS AND THE LIKE

BACKGROUND OF THE INVENTION

1. Field of the Invention

The present invention relates to a machine forming, filling and sealing sacks and the like, starting from a continuous, flat, tubular strip, either straight or folded, of heat-sealable plastic material.

2. Description of the Prior Art

Presently known machines of the type indicated above are not without problems and disadvantages of both a practical and a functional nature. The main problem is due to the somewhat complex system used to move the empty sacks from the forming station to the filling station, and from the latter to the sealing station for the full sacks, as the devices provided to perform the above mentioned operations are in a fixed position, and the sacks must therefore perform a series of vertical and horizontal movements to avoid interfering with said devices, which causes an extension of the operating times and machine working cycle.

As will be shown more clearly during the course the present description, further disadvantages can also be seen in these conventional machines. For example in the systems for loosening the empty sack and tightening the full one, the sacks are gripped by respective translation gripping means, respectively to open the mouth of the former ready for filling and to cause the edges of the latter to adhere ready for sealing of the mouth thereof. Another disadvantage relates to the fixed suction cup systems for widening of the sack for filling.

SUMMARY OF THE INVENTION

Object of the present invention is, therefore, to provide a machine for forming, filling and sealing sacks and the like made of heat sealable plastic material, capable of overcoming the problems and disadvantages mentioned above found in similar conventional machines, by means of an arrangement of devices capable of allowing translation of the sacks between the forming, filling and sealing stations exclusively following a straight, horizontal route.

A further object of the present invention is to provide improvements to the systems for loosening the empty sacks and tightening the full ones when gripped by translation gripping means.

A further object of the present invention is to provide improvements to the suction cup systems for opening the mouths of the sacks ready for filling.

The invention provides a machine for forming, filling and sealing a succession of sacks having a fixed size, starting from a continuous, flat tubular tape, either straight or folded, of heat-sealable plastic material, comprising: A) a first sack formation station including first supports and, carried on said first supports, first welding means, cutting means and first retaining means; B) a sack filling station comprising second retaining means for said single sack, means for opening the mouth of the sack, and means for holding the mouth of the sack open; C) a station for sealing the mouth of said single sack, including second supports and, carried by said second supports, second welding means and third retaining means, said machine being characterized by the fact that:

a carriage group for the sacks comprises a carriage moving between a first and a second position by means of a horizontal translation movement, and means for gripping the sacks are carried by said carriage to bring an empty sack from the formation station to the filling station and to bring a full sack from the filling station to the sealing station;

said first and second supports respectively in the formation station and the sealing station, and also said second sack retaining means and the means for holding the mouth of the sack open in the filling station, are moved downward into their working positions in their respective stations and are moved upward into their rest position, so that the horizontal movement of said retaining means for gripping the sacks in the carriage group can be performed without interfering with said first and second supports and with said second retaining means holding the sack;

and said means for opening the mouth of the sack in the filling station are carried by said movement from a working position on the mouth of the sack to a rest position, in which they do not interfere with the filled sack in the filling station during the return stroke of the carriage toward its above mentioned first position, so that the movement of the sacks between the various stations takes place horizontally and in a straight line.

BRIEF DESCRIPTION OF THE DRAWINGS

The present invention will be more clearly described below in the description of a preferred embodiment thereof, given merely as a non-limiting example, with reference to the enclosed drawings, in which:

FIG. 8 is a schematic plan view from above showing an alternative system for sealing the mouth of a filled sack;

FIGS. 9, 10, 11 and 12 are schematic views illustrating the subsequent stages for sealing of the mouth of a filled sack using the system according to FIG. 8.

DESCRIPTION OF THE PREFERRED EMBODIMENTS

Figure 1:
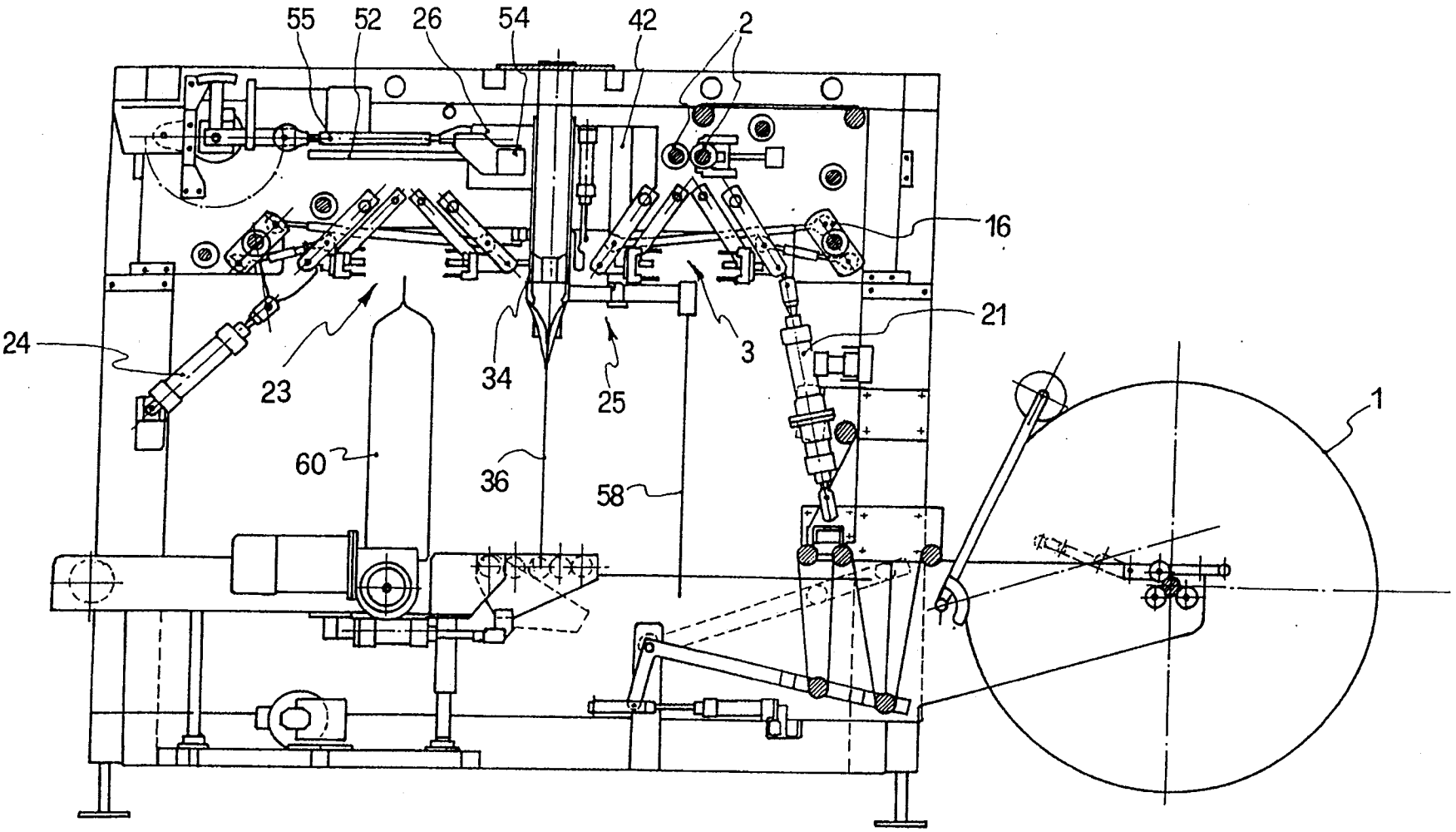
FIG. 1 is a schematic side view with portions removed of the machine in reference.

With reference to FIG. 1, there is shown, with portions removed, a schematic side view of the machine according to the invention as a whole, in which a detailed description will not be given of parts which, although shown, are common to similar known machines.

Said machine comprises a reel 1 on which is wound a flat, continuous tubular tape of heat sealable plastic (not shown), which can be either straight or folded, the free end portion of which is placed between two opposite rubber driver rollers 2. The rollers are pressed one against the other by springs, which provide for unwinding the tubular tape according to the subsequent lengths required to form the sacks one after another. During the unwinding, each length of tubular tape is made to travel upward first and then downward until its free lower edge, which is to become the base of the sack to be formed, reaches a position beneath a sack formation station generally indicated in 3.

Figure 2:
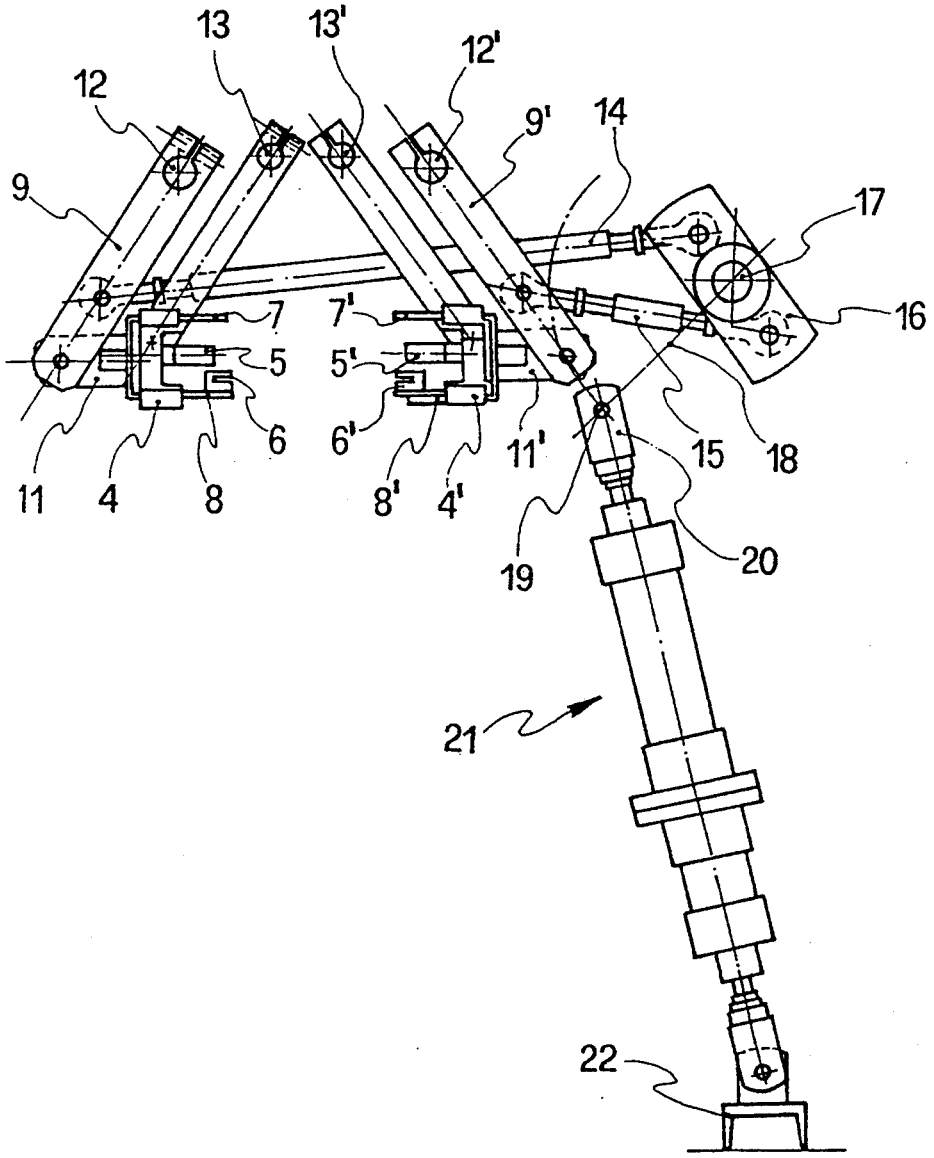
FIGS. 2 and 3 are schematic views of the groups for formation of the, sacks to be filled and for sealing of the filled sacks, respectively, in the machine according to FIG. 1.

The sack formation station 3, as can be more clearly seen from FIG. 2, comprises two substantially C-shaped first supports 4, 4' of a length substantially equal to, or preferably greater than, the width of said tubular tape, that is to say the width of the sack to be formed. Along the first supports are fixed in an opposed relationship respective welding bars 5, 5' in a central position, and respective cutting blades 6, 6' below. Each support is furthermore provided with a C-shaped element whose two ends form two pressers, an upper presser 7, 7' and a lower presser 8, 8', aligned with the corresponding one on the other support. The pressers 7, 7' and 8, 8' form first retaining means and they are slidable in guides formed through the respective first support 4, 4' and constantly stressed by springs (not shown) towards the inside of the station 3. The function of these pressers will be illustrated in the following.

The end portions of each first support 4, 4' are associated with respective pairs of articulated lever systems, only one of which is illustrated for each support 4, 4' and indicated with 9, 10 and 9', 10'. The levers 9, 10 and 9', 10' of each of said pairs, which rotate together, have their lower ends rotatably hinged to the free ends of respective arms, of which only those relating to levers 9, 9' are visible, and are indicated with 11, 11'. These arms are fixed to the rear surfaces of the respective first supports 4, 4', while their upper ends are rotatably supported on respective shafts 12, 13 and 12', 13' fixed to the frame of the machine. The two pairs of levers on one first support form, along with the corresponding pairs on the other first support, an equal number of articulated parallelograms destined to move the supports 4, 4' in a vertical direction and also towards and away from each other on a same plane.

One of the two pairs of levers 9, 10 and 9', 10' in each of the two pairs associated to a respective support 4, 4', and more specifically the one indicated with 9, 9' in FIGS. 1 and 2, is connected by means of tie rods 14 and 15, the length of which can be adjusted, to one end of a respective link, of which only one is shown in the above figures and indicated with 16. Each link 16 is keyed to a rotation shaft 17, to which is rotatably fixed one end of a crank lever, shown schematically by line 18. The other end of crank 18 is rotatably mounted, by means of a pin 19, on the fork-shaped end 20 of the piston rod of the long stroke upper portion of a double end pneumatic cylinder, generally indicated with 21, fixed to the frame of the machine. The lower, short stroke portion of the cylinder has its end connected to a base support 22.

Figure 3:
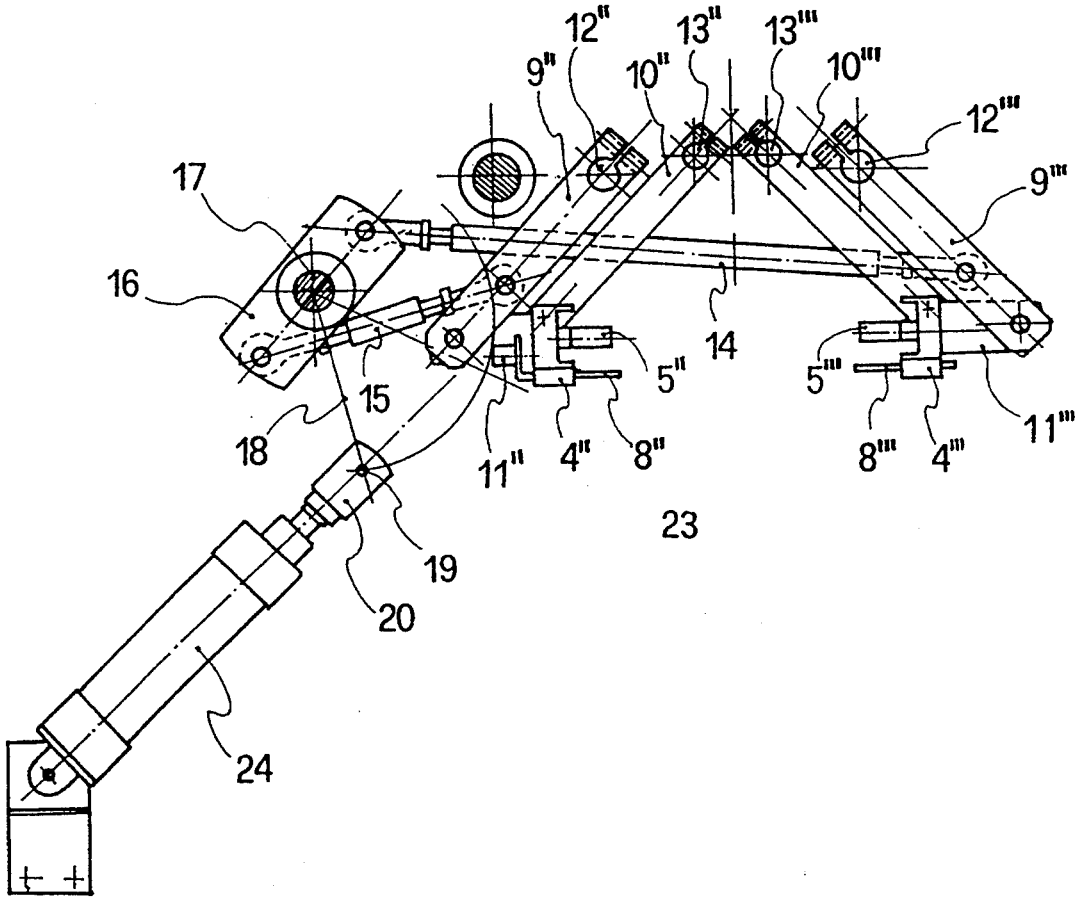

In FIG. 3 is illustrated the sealing station for the mouths of the filled sacks, generally indicated with 23, which is substantially similar to the station 3, so that elements similar to those used in the latter and described above will be indicated with the same reference numbers primed two or three times without giving a detailed illustration thereof. It is to be noted, however, that in station 23 along with the welding bars 5'', 5''', only the lower pressers 8'', 8''' (third retaining means) are present on second supports 4'' and 4''', and that the double ended pneumatic cylinder in station 3 is here replaced by a normal double acting pneumatic cylinder 24.

As shown in FIG. 1, below the sack formation station 3 is a carriage group, generally indicated with 25, movable in a horizontal direction by means of two hangers 42, 42' extending toward the base of a main carriage 26, 26'.

The carriage group 25 comprises a carriage made up of two parts 26, 26' which runs on two transversal guides 52, 52' fixed to the frame of the machine (see FIGS. 1, 6, 7 and 13). The two parts 26, 26' of the carriage are joined by a beam 54. The beam 54 is moved by a connecting rod and crank system 55. Each carriage 26, 26' carries an appendix 42, 42'. Each appendix carries a first pair of pincers 27, 27' (FIGS. 4, 5) and the other appendix carries a second pair of pincers 28, 28'.

Figure 4:
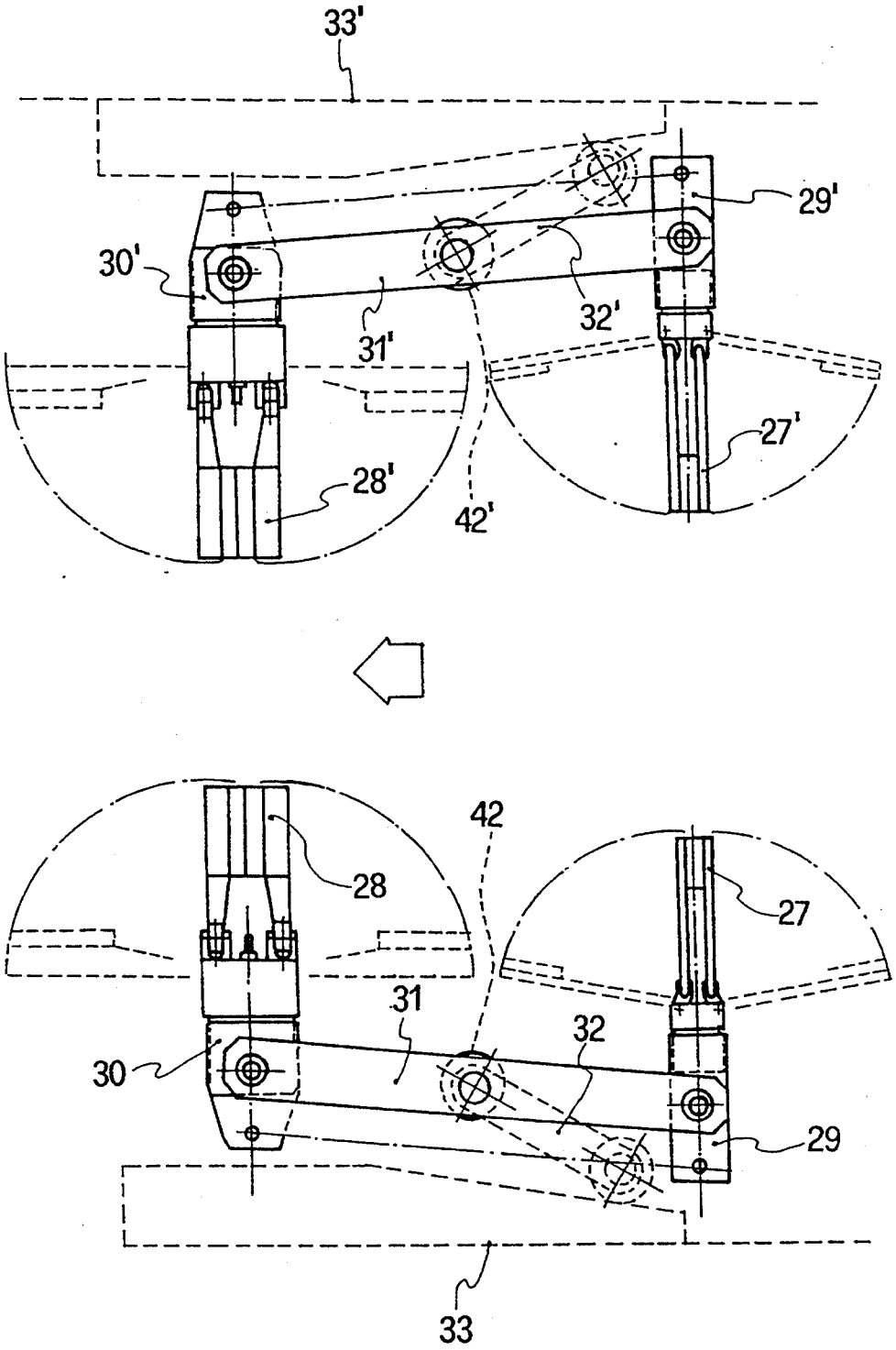
FIGS. 4 and 5 are schematic plan views from above of the sack gripping devices for translation to respective working positions, further showing the system for loosening an empty sack ready to open its mouth for filling and for tightening a full sack ready to seal its mouth, in the machine according to FIG. 1.
Figure 5:
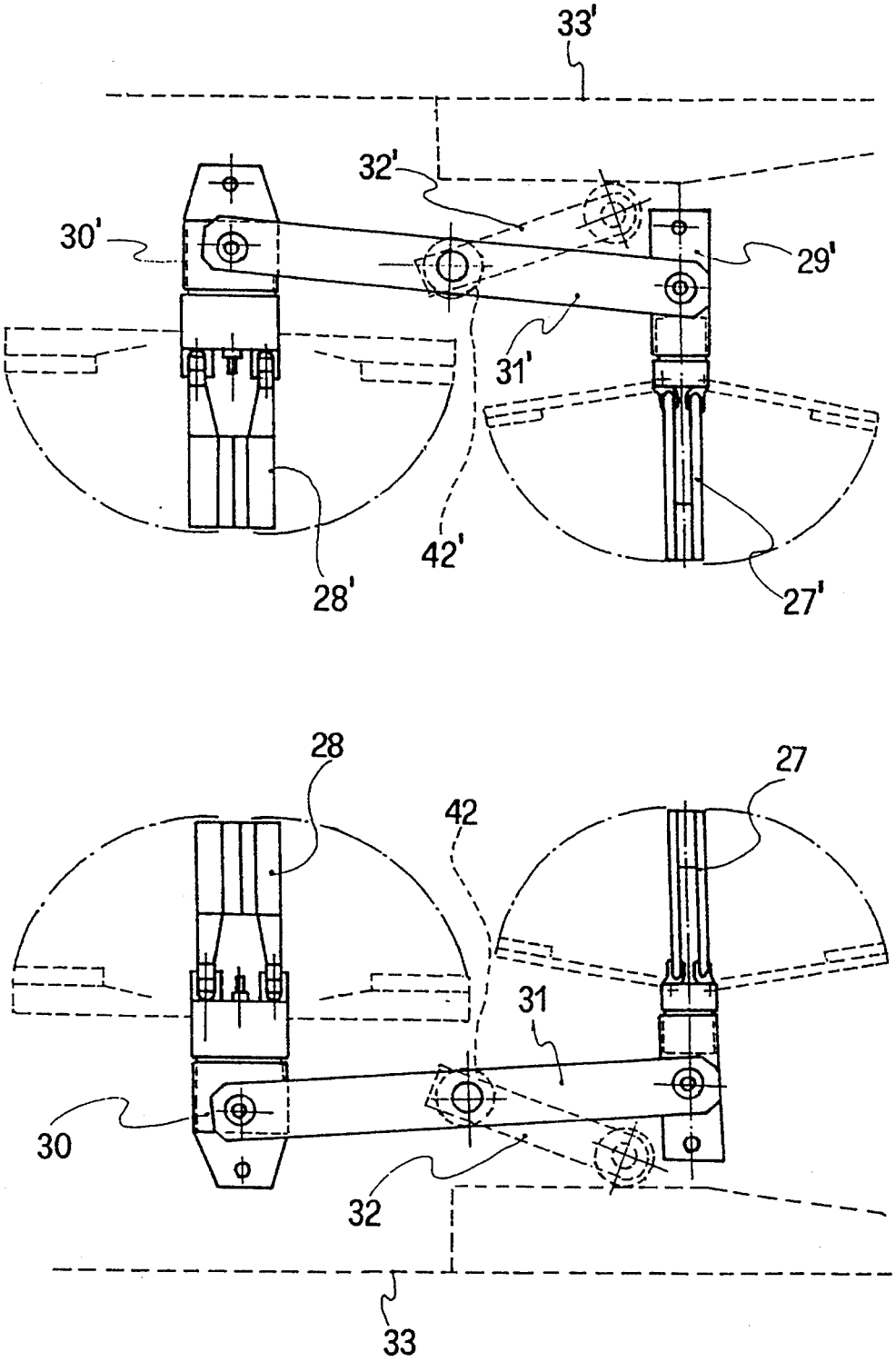

The carriage group 25, as can be seen more clearly in FIGS. 4 and 5, comprises as a means for gripping a sack, a first pair of pincers 27 and 27', to grip an empty sack 58 that has just been formed in the station 3, and a second pair of pincers 28, 28' to grip a filled sack. All pincers are capable of rotating on respective supports 29, 29' and 30, 30' from a closed position illustrated in a solid line and an open position illustrated in a dotted line in the above figures. The supports 29, 30 and 29', 30' corresponding to each pair of pincers are pivotably connected by respective beams 31, 31'. On the same central part of each beam is fixedly secured one end of a cam follower 32, 32', the other end of which is in rolling contact with a respective cam surface 33, 33'. The arrangement of the cam system is such that when the carriage group 25 moves to the left, as seen in FIG. 1 and as indicated by the arrow in FIG. 4, to bring the empty sack 58 up to be filled and the full sack 60 to have its mouth sealed, the cam followers 32, 32' moving on their respective cams 33, 33' give an anti-clockwise rotation of the beams 31, 31' around their respective central pivots. This, as seen in FIG. 5, causes the pincers 27, 27' in the first pair to come together, so as to loosen the empty sack held between them (not shown) and facilitate its subsequent opening for filling, as will be described in the following, and also causes the pincers 28, 28' in the second pair to move apart, so as to tighten the full sack held between them (not shown) to allow subsequent correct sealing of the mouth thereof, which will also be more fully described in the following.

Figure 6:
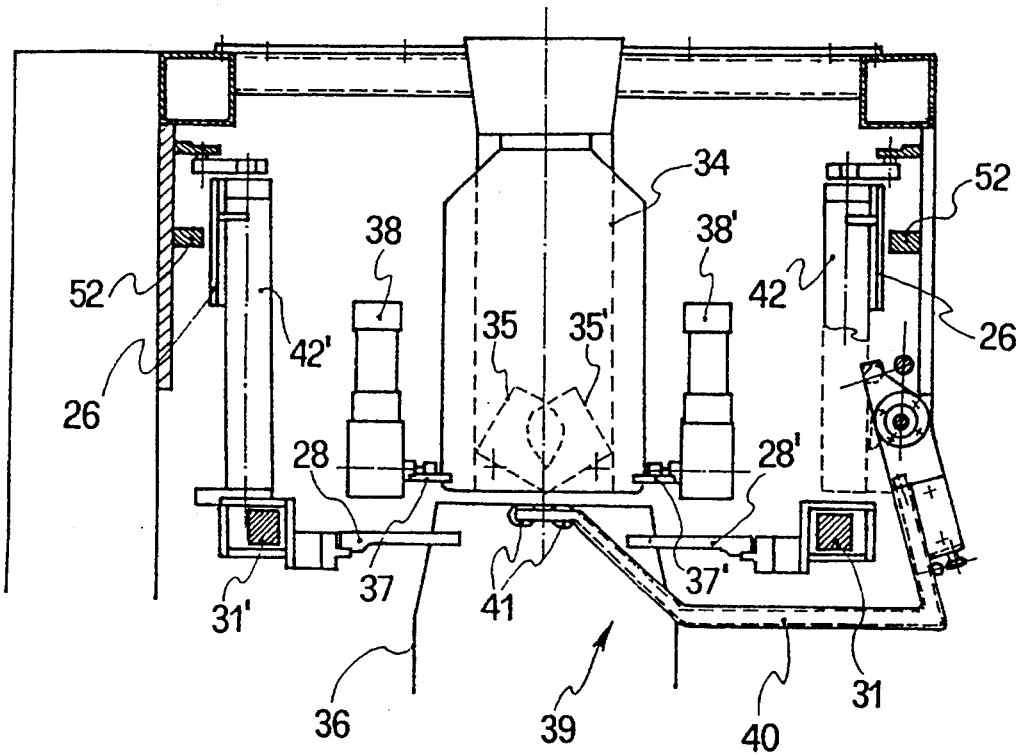
FIGS. 6 and 7 are schematic elevations of the group for filling a sack, in which the suction cup system for opening the mouth of the sack is also shown, in the machine according to FIG. 1.
Figure 7:
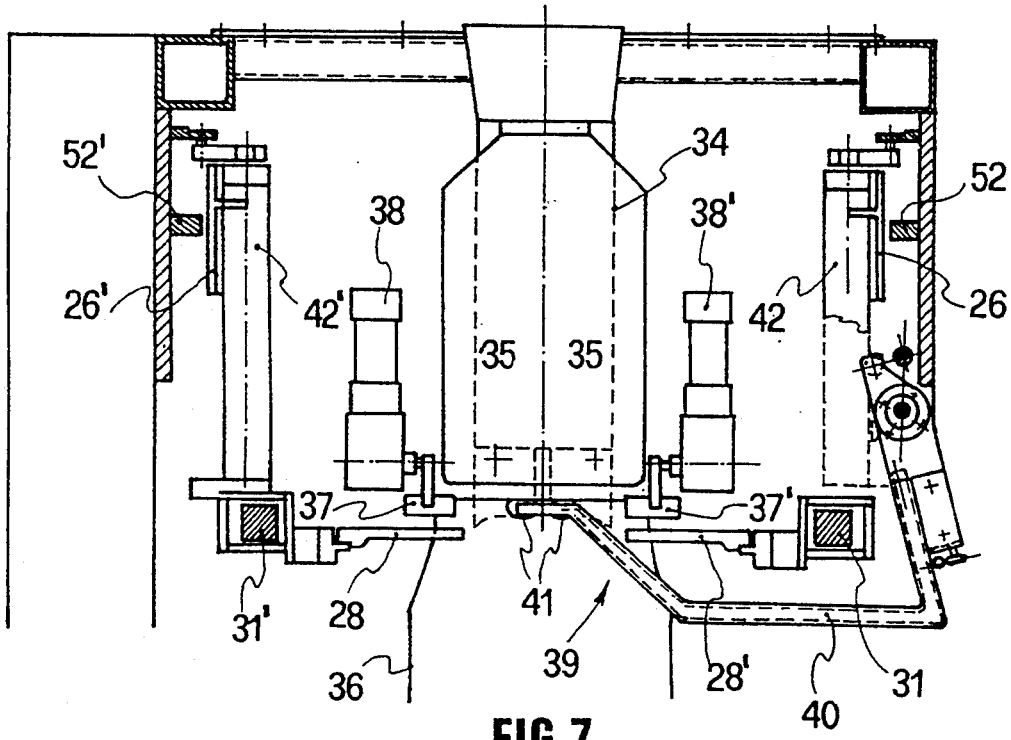
Figure 13:
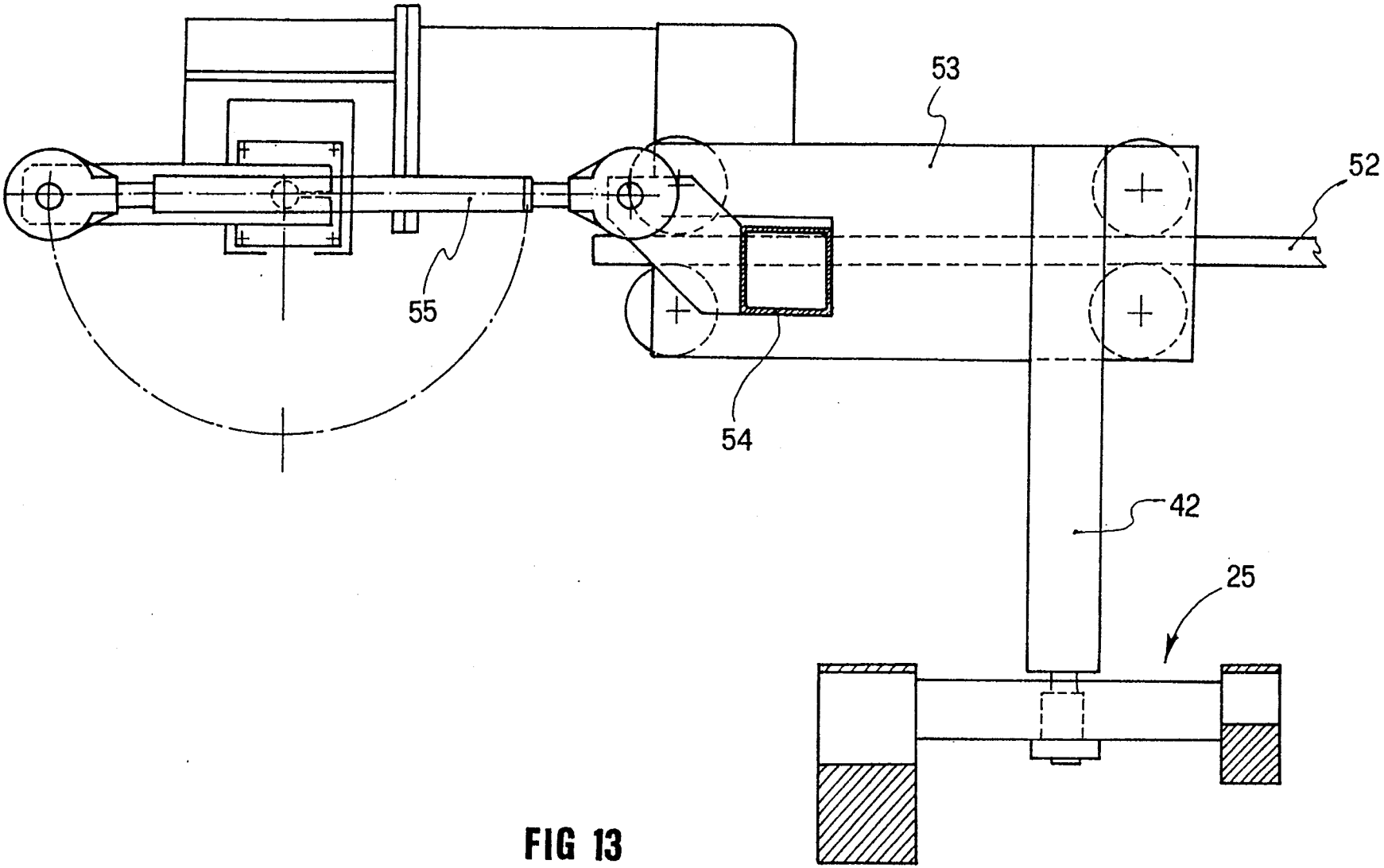
FIG. 13 is a schematic side elevation view of one of the parts of the carriage.

In FIGS. 6 and 7 the filling station 34 for sacks is shown in its preparatory and working positions, respectively.

With reference to the above mentioned figures, there is shown in 34 a sack binder arranged below a feeder hopper for the product with which the sacks are to be filled. Close to the lower edge of the sack binder 34 means for holding the sack mouth open are hinged such as two shaped mobile elements 35 which, when in a disengaged position (see FIG. 6) are folded inside the sack binder 34 so as not to interfere with positioning of the sack 36 to be filled, whereas in the operating position they are extended so as to penetrate into the open mouth of the sack 36 (see FIG. 7). The shaping of the mobile elements 35 is such that when in the extended operating position of FIG. 7 they form substantially an extension of the outer wall of the sack binder 34.

On opposite sides of the sack binder 34 are provided in a fixed position second retaining means comprising respective pairs of pincers, of which only one of each pair is shown and indicated with 37 and 37', capable of rotating by means of respective double acting pneumatic cylinders 38, 38' from a raised disengaged position (see FIG. 6) to a lowered working position (see FIG. 7), in which they grip opposite edges of the open mouth of the sack 36.

Means for opening the mouth of the sack 36, according to the present invention, comprise two opposite suction groups, of which only one is shown in a working position in FIGS. 6 and 7, and is generally indicated with 39. These suction groups, unlike the similar systems in machines according to the state of the art, can be moved, with a movement connected to and simultaneous with the translation of beams 31 and 31' by carriage 26. This makes it possible to grip in advance the empty sack. As the sack is held in a loosened position, as described above, by the first pair of pincers 27, 27' the mouth of said sack has already taken on its elliptical shape at the moment in which it arrives beneath the sack binder 34, so as to reduce working time.

Each of said suction groups 39 comprises a shaped tubular arm 40 on the free end of which is arranged a pair of suction cups 41 and through which the suction cups 41 are fed with a negative pressure by means, for example, of a vacuum pump (not shown) or the like. The other end of the arm 40 is connected by means of a system of articulated levers (not shown) to the hanger 42 of the pair of hangers on the main carriage 26, the pair of hangers being indicated here with 42 and 42'. To the hangers are also pivotally connected respective beams 31, 31' shown in cross section in FIGS. 6 and 7, connecting the pincers 27, 28 with pincers 27, 28'. The respective pincers 28, 28' of the second pair are gripping the sack 36 beneath the corresponding pincers 37, 37' which are associated in a fixed position, as mentioned above, with the sack binder 34. The above mentioned connection of the arm 40 causes the arm itself, by means of a first and second double acting pneumatic cylinder (not shown), to perform a rotational movement parallel to the plane of the sheet, and a simultaneous translational movement perpendicular to the plane of the sheet between a lowered disengaged position such as not to interfere with movement of the sacks and a raised working position such as to bring the suction cups into contact with the empty sack. This is simultaneously gripped by the first pair of pincers 27, 27' in the group 25, during its translation towards the sack binder 34.

As previously described with reference to FIG. 3, in the present machine there is provided a device for direct sealing of the edges of the mouth of each sack after it has been filled, using the welding bars 5'' and 5''' in the group 23. However, it sometimes happens that the material previously poured into the sack is of a type that will stick to the inner surfaces of the edges to be welded, rendering the welding difficult or even impossible.

In these cases, instead of welding the edges of the mouth of the sack directly, the external application of a strip folded into the shape of an upside-down U is known, the strip being generally of the same material as the sack. The strip is then welded to the sack so as to seal the mouth thereof.

In the machine according to the present invention a new and original system has been studied for application of the external strip to seal the mouth of the sack, which will be illustrated in the following with reference to FIGS. 8 and 9.

In FIG. 8 is shown a system for forming each of these strips to measure, starting from a continuous tape wound on a reel 56. The tape is pulled off the reel by means of two driver rollers 43, and directed towards a pair of endless belt conveyors 44 and 44' placed one above the other in a parallel and spaced relationship. The tape reaches the conveyors cut to measure so as to form a sealing strip 45 with an appropriate length L at least equal to the width of the sack to which it is to be applied. The sealing strip 45 will be held on the outer faces of the front portions of the belt conveyors 44, 44' by means of a suction device 46 placed between the conveyors themselves, as will be seen more clearly in FIG. 9. In the position described above the sealing strip 45 extends in the vicinity and along the side of the filled sack 36 in correspondence with the closed edges of the mouth thereof, said closing being due to the action of the cam 33 (FIGS. 4 and 5) which causes the second pair of pincers 28, 28' to move away, as stated above, and thus tightens the sack held between them.

As can be seen from FIG. 9, on the upper surface of the support 47 for the belt conveyors 44, 44' and the suction device 46, a folding device for the welding strip 45 is mounted, generally indicated with 48. Said device is made up of a support 49 on which is slidingly arranged a thrust element 50 capable of being moved towards and away from the sealing strip 45 in the above mentioned position, said sealing strip being held on the belt conveyors 44, 44' by means of the suction device 46.

At this point it is necessary to specify that the group of components forming the system described above for application of the sealing strip 45 for the mouth of the full sack is positioned in the vicinity of the group 23, and uses the welding bars 5'' and 5''' to weld the strip.

When the above described machine is in operation, the flat, tubular tape of plastic material coming off the reel 1 is unrolled by the driver rollers 2 until its free end portion is slightly below the sack formation station 3. At this point, by means of both the short and long strokes of the double ended pneumatic cylinder 21, the links 16 are made to rotate, through the crank 18, in such a way as to determine, by means of tie rods 14 and 15, the rotation of the pair of levers 9, 10 and 9', 10' forming an articulated parallelogram. This causes station 3 to descend and close so that the welding bars 5, 5' form a seal across the width of the tubular tape, which is gripped and held taught by the pressers 7, 8 and 7', 8', thus forming the bottom of the first sack. Following subsequent opening of the station 3 the tubular tape is brought down by a length equivalent to the length desired for the sack. Then station 3 closes once again to form the base of the second sack, and also, below this, to cut the tubular tape, by means of blades 6, 6', so as to form the mouth of said first sack. This first sack, following the subsequent opening of station 3, is gripped by the first pair of pincers 27, 27' to be transferred by the transversal movement of carriage 26 which drives the beams 31, 31' under the sack binder 34. Here it will arrive with its mouth in an open position following intervention by the suction groups 39 during the translational movement, as described above. With the sack in this position, the pincers 37, 37' associated with the sack binder 34 rotate downward from the disengaged position of FIG. 6 to grip the mouth of the sack 36 as shown in FIG. 7. The shaped elements 35 in the sack binder 34 rotate from the folded position of FIG. 6 into the extended working position of FIG. 7, penetrating into the mouth of the sack 36. The first pair of pincers 27, 27' disengages and the carriage 26 and beams 31, 31' perform a reverse translational movement to bring the pincers 27, 27' back to their starting position and allow the sack to be gripped by the second pair of pincers 28, 28' (FIGS. 6 and 7). The sack that has been formed in the meantime by station 3, awaiting the return of pincers 27, 27' remains attached to station 3 itself, held by the pressers 8, 8'. The performance of the short stroke only of pneumatic cylinder 21 causes in fact the detachment of the welding bars 5, 5' and the cutting blades 6, 6' but not that of the pressers, which are still held by their respective springs in a gripping position. With the pincers 27, 27' back in their starting position, that is to say in the position shown in FIG. 1, the sack waiting on station 3 is gripped by the pincers, while the sack under the sack binder 34 finishes being filled. The subsequent transversal translation movement of the carriage group 25 and pincers to the left, as shown in FIG. 1, brings the new empty sack, held by the first pair of pincers 27, 27', under the sack binder 34 and the full sack, held by the second pair of pincers 28, 28', under the sealing group 23. The empty sack and the full sack are made to undergo during said translational movement a loosening and a tightening action, respectively, as stated above, by virtue of cams 33, 33'. The same process described above will also be followed for the new empty sack under the sack binder 34, while the full sack under the group 23 undergoes sealing of its mouth by means of the welding bars 5'' and 5'''. Following descent and closing of station 3 due to rotation of the pairs of levers 9'', 9''' and 10'', 10''' forming an articulated parallelogram, under the action of the pneumatic cylinder 24 through the cranks 16 and the links 18, the pressers 8'' and 8''' grip the upper edge of the sack itself, so as to allow the second pair of pincers 28, 28' to disengage. This allows the carriage group 25 to return to its starting position to repeat the cycle described above for each sack formed in the meantime in station 3.

Should it be impossible to effect direct sealing of the mouth of the sack as described above, for example due to the adhesion on the inner surface of the mouth of the sack of the material with which it is filled, an external sealing strip 45 is applied, as described with reference to FIGS. 8 to 12 in particular according to the stages illustrated in succession in FIGS. 9 to 12. In FIG. 9 the sealing strip 45 is positioned in a distended position on one side of the mouth of the sack 36 held against the belt conveyors 44, 44' by the suction device 46. In FIG. 10 the upper half of the strip 45 is folded onto the other side of the mouth of the sack 36 by sliding forward of the thrust element 50. In FIG. 11 the welding bars 5'' and 5''', forming part of the group 23, are brought into contact with the strip 45 folded as indicated above, to weld it on opposite sides of the mouth of the sack, and in FIG. 12 is shown the sack 36 sealed as indicated above.

From the above it can be seen that, using the machine according to the present invention, it has been possible to obtain, along with various other important innovations, the object of moving the sacks between the various work stations following a straight horizontal course, unlike the complex course followed by sacks in similar conventional machines, giving a consequent reduction in the time required to complete each working cycle in the machine in question, as well as the elimination of components, thus giving a reduction in manufacturing costs.

The present invention is not limited to the embodiment described, but includes any variations thereof.

I claim:

1. Automatic machine for forming, filling and sealing a succession of sacks having a fixed size, starting from a continuous, flat tubular tape, either straight or folded, of heat-sealable plastic material, said machine comprising: A) a first sack formation station (3) including first supports (4, 4'), and, carried on said first supports (4, 4') first welding means (5, 5'), cutting means (6, 6') and first retaining means (7, 7', 8, 8'); B) a sack filling station (34) comprising second retaining means (37, 37') for a single sack of said sacks, means (41) for opening the mouth of the single sack and means for holding the mouth of the single sack open (35, 35'); C) a station (23) for sealing the mouth of said single sack, including second supports (4'', 4'''), and, carried on said second supports (4'', 4''') second welding means (5'', 5''') and third retaining means (8'', 8''') , said machine further comprising:

a carriage group (25) for the sacks which includes a carriage (26, 26') moving between a first and a second position by means of a horizontal translation movement, and means for gripping the sacks (27, 27', 28, 28') engaged on said carriage (26, 26') to bring an empty sack of said sacks from the formation station (3) to the filling station (34) and to bring a full sack of said sacks from the filling station (34) to the sealing station (23);

said first and second supports (4, 4', 4'', 4''') located respectively in the formation station (3) and the sealing station (23), said second sack retaining means (37, 37') and the means for holding the mouth of the sack open (35, 35') in the filling station (34), each of said first and second supports, said second sack retaining means and said means for holding the mouth of the sack open having positioning means for moving each of said first and second supports, said second sack retaining means and said means for holding the mouth of the sack open downward into a working position in each respective station and upward into a rest position, said positioning means permitting the horizontal translation movement of said retaining means (27, 27', 28, 28') for gripping the sacks (28, 28') in the carriage group (25) without interfering with said first and second supports (4, 4', 4'', 4''') and with said second retaining means (37, 37') holding the sack;

and said means for opening the mouth of the sack (41) in the filling station being engaged on said carriage group (25) and having rotating means for rotational movement from a working position on the mouth of the sack to a rest position, in which the means for opening the mouth of the sack does not interfere with the filled sack in the filling station (34) during the return stroke of the carriage (26, 26') toward said first position, wherein the movement of the sacks between the various stations takes place horizontally and in a straight line.

2. Machine according to claim 1, in which said means (27, 27', 28, 28') for gripping the sacks carried by said carriage (26, 26') comprise:

vertical appendixes (42, 42') engaged by a respective part (26, 26') of the carriage;

beams (31, 31') connected rotatably at their center with one end of said appendix (42, 42');

a cam follower (32, 32') fixed integrally to one end of each beam, having its other end slidingly engaged with a cam (33, 33'), said cam being fixed with respect to the frame of the machine;

a first pair of pincers (27, 27') and a second pair of pincers (28, 28'), said first and second pair of pincers being rotatably connected to respective ends of said beams (31, 31'), the cross-section of said cam (33, 33') being such as to determine automatically a decrease in the distance between said first pair of pincers (27, 27') and at the same time an increase in the distance between the second pair of pincers (28, 28') during the translation of the carriage (26), so as to loosen and respectively tighten the grip on the sack held by said first and second pair of pincers.

3. Machine according to claim 1, in which said loosening of the grip is produced in correspondence with transportation of the sack from the formation station to the filling station and said increasing of the grip is produced simultaneously in correspondence with transportation of the sack from the filling station to the sealing station.

4. Machine according to claim 1, in which said means (41) for opening the mouth of the sack at the filling station comprise two suction cup groups (39) opposite one another, each of which comprises:

a shaped tubular arm (40);

a pair of suction cups (41) arranged on a free end of the arm;

a vacuum source connected to the suction cups through said arm (40);

a system of articulated levers connecting the other end of the arm to said carriage (26, 26');

a first and a second double acting pneumatic cylinder to activate said articulated system and to make said arm perform a rotational movement on a vertical plane and simultaneously a translational movement on a horizontal plane between a lowered, disengaged position in which it does not interfere with the movement of said sacks, and a raised, working position in which it carries said suction cups into contact with the empty sack gripped by said first pair of pincers (27, 27') during their translation towards the filling station.

5. Machine according to claim 1, in which said formation station for the successive formation of said single sack comprises:

a pair of said first opposite supports (4, 4'), each one including a welding bar (5, 5') for sealing the bottom of each sack being formed, a cutting blade (6, 6') for separating each sack being formed from said continuous tubular tape, and said first retaining means having a pair of presser elements (7, 8 and 7', 8') to hold this tubular tape during welding and cutting operation and to hold the formed sack until it is picked up by the carriage group (25); pairs of articulated lever systems (9, 10 and 9', 10') connected to a respective support (4, 4') and forming articulated parallelograms; a double ended pneumatic cylinder (21) with a short stroke and a long stroke, connected to said articulated lever systems by means of a connecting rod and crank system, said articulated lever systems adjusting said supports (4, 4'), downward and towards each other until reaching a working position during the extended stroke of the pneumatic cylinder (21), and upward and away from each other until reaching a rest position, during the retracting stroke of the pneumatic cylinder (21), while said short retracting stroke of the pneumatic cylinder (21) determines a partial distancing of said supports (4, 4') from each other, so that only said presser elements remain-engaged with the sack just formed and waiting to be grasped by said sack gripping means (27, 27', 28, 28') carried on said carriage (26, 26').

6. Machine according to claim 1 in which said filling station comprises: a hopper feeding in the product with which the sacks are to be filled; a sack binder (34) arranged under said hopper; two moving shaped elements (35) having a hinge close to the lower edge of said sack binder to permit moving from a disengaged position to a working position, said moving elements (35) when in their disengaged position being rotated around said hinge to be inside the sack binder (34) so as not to interfere with the positioning of the sack to be filled carried by the carriage group (25), while when they are in their working position they extend to penetrate inside the mouth of the underlying sack, the shape of said moving elements being such that in an extended position they form substantially an elongation of the external wall of the sack binder.

7. Machine according to claim 1, in which said sealing station (23) comprises: a pair of said second opposite supports (4'', 4''') and, carried by said second supports, a pair of welding bars (5'', 5''') and said third retaining means, made up of a pair of presser elements (8'', 8''') to hold a full sack during the operation for sealing of mouth thereof; pairs of articulated lever systems (9'', 10'' and 9''', 10''') connected to said second supports (4'', 4''') and forming articulated parallelograms; a double acting pneumatic cylinder (24) connected to said articulated lever systems by means of a connecting rod and crank system (18, 16), said articulated lever systems adjusting said second supports (4'', 4''') downward and towards each other until reaching a working position for sealing the mouth of the full sack during the extending stroke of the pneumatic cylinder (24) and upward and away from each other until reaching said disengaged position during the retracting stroke of said pneumatic cylinder (24).

8. Machine according to claim 1, further comprising, adjacent to said sealing station (23), a device for sealing the mouth of a full sack by means of application and welding of an external strip (45) of flexible heat-sealable material folded in the shape of a U over the mouth of said full sack, in case it should be impossible to perform direct sealing of the edges of the mouth of the sack in the sealing station (23), said device comprising: a reel (42) holding a continuous tape of said flexible heat-sealable material; means (43) for unwinding said continuous tape and for sending said strip (45), obtained following cutting to measure of said continuous tape, on a pair of endless conveyor belts (44, 44'), arranged one on top of the other and spaced, on which said strip (45) is held by means of suction devices (46) and by which it is brought into contact with one side of the mouth of said full sack, which is positioned in correspondence with a fourth group (23); angular sliding means (50) for folding said strip (45) away from its extended position on said belt conveyors (44) into a position straddling the mouth of said full sack to be sealed, in which position it is then welded to said welding bars (5'', 5''') in said fourth group (23), thus sealing the mouth of said full sack.

* * * * *

UNITED STATES PATENT AND TRADEMARK OFFICE

CERTIFICATE OF CORRECTION

PATENT NO. : 5,448,879
DATED : September 12, 1995
INVENTOR(S) : T. CONCETTI

It is certified that error appears in the above-indentified patent and that said Letters Patent is hereby corrected as shown below:

Title page, column 1, item 30 (Foreign Application Priority Data), change "RM92A0779" to --RM92A000779--.

Signed and Sealed this

Twelfth Day of December, 1995

*Attest:*

Bruce Lehman

BRUCE LEHMAN

*Attesting Officer*

*Commissioner of Patents and Trademarks*